United States Patent [19]

Skinner et al.

[11] Patent Number: 4,633,798

[45] Date of Patent: Jan. 6, 1987

[54] SAILBOAT BATTENS

[76] Inventors: A. Homer Skinner, 9 Harding La., Marblehead, Mass. 01945; Graham T. Skinner, 10145 Camino Vista Dr., Monta Vista, Calif. 95014

[21] Appl. No.: 508,859

[22] Filed: Feb. 27, 1984

Related U.S. Application Data

[63] Continuation of Ser. No. 214,457, Dec. 8, 1980, abandoned.

[51] Int. Cl.[4] ..... B63H 9/04

[52] U.S. Cl. ..... 114/107; 114/39; 114/103; 114/106

[58] Field of Search ..... 114/103, 102, 104, 106, 114/107, 39

[56] References Cited

U.S. PATENT DOCUMENTS

| | | | |
|---|---|---|---|
| 2,561,253 | 7/1951 | Wells-Coates | 114/103 |
| 2,589,203 | 3/1952 | Nilsen | 114/103 |
| 2,603,286 | 7/1952 | Miao | 160/178 R |
| 2,608,172 | 8/1952 | Biuw | 114/103 |
| 3,367,604 | 2/1968 | Matteo | 244/1 |
| 3,472,305 | 10/1969 | Lefes | 160/178 R |
| 3,528,543 | 9/1970 | Robinsky | 206/59 |
| 3,581,698 | 6/1971 | Bete | 114/103 |
| 3,862,528 | 1/1975 | Meissinger | 52/108 |
| 3,905,321 | 9/1975 | Blythe, Jr. | 114/103 |
| 4,047,339 | 9/1977 | Smith | 52/108 |
| 4,064,821 | 12/1977 | Roberts | 114/103 |

FOREIGN PATENT DOCUMENTS

| | | | |
|---|---|---|---|
| 603355 | 4/1960 | Italy | 160/178 |

OTHER PUBLICATIONS

A Complete Guide to the Sport of Windsurfing,—Bay Windsurfing, Menlo Park, Calif., 1979 by Glen Taylor; p. 9.

*Primary Examiner*—Galen L. Barefoot
*Assistant Examiner*—C. T. Bartz

[57] ABSTRACT

A sail batten suitable for roller-furling and composed of one or more long thin elements of a material possessing great stiffness and yield strength. The elements are formed so that their longitudinal cross-section is smoothly curved. Consequently this batten is stiff enough to provide the control of sail shape for which battens are used. Yet it is so resilient that, like a carpenter's rule, it flattens without damage into a flexible ribbon which coils tightly about a transverse axis. Thus a batten for sails which furl or reef about any axis. Chafe at an end is minimized by tapering the batten towards that end. Elements of compound curvature provide antisymmetrical stiffness to resist distortion of the sail to either side. Other species which achieve the same result are elements of opposing curvature nested in pockets together and elements of opposing curvature in substantially parallel pockets. Rigid connections between elements are only made at the end of the bundle which will be wound up first. Pockets are provided with elasticity at the ends which are rolled up last. These two properties increase durability by allowing relative slip between the parts of the system during roll-up.

11 Claims, 14 Drawing Figures

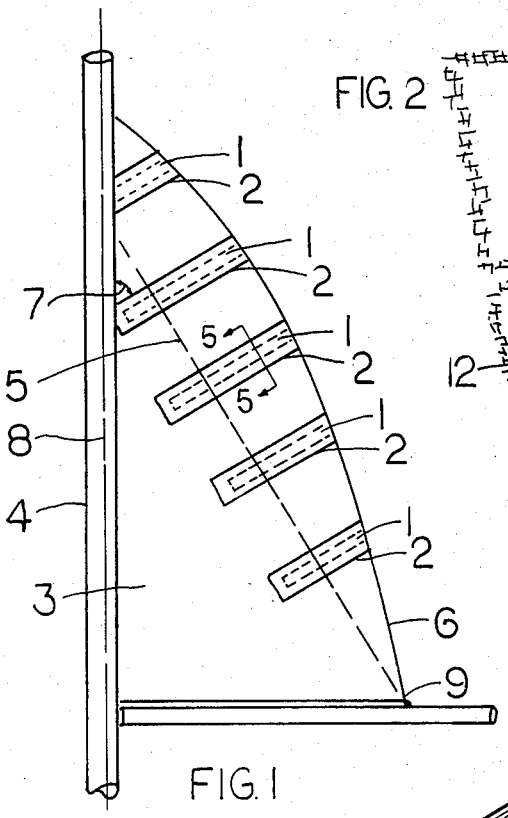
FIG. 1
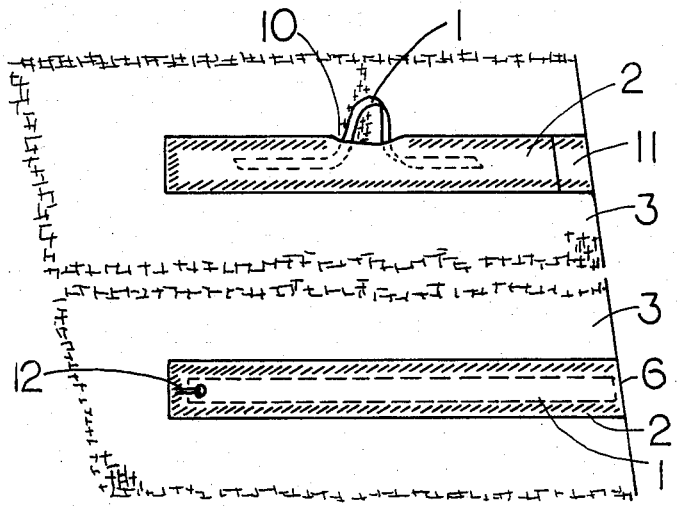
FIG. 2
FIG. 3
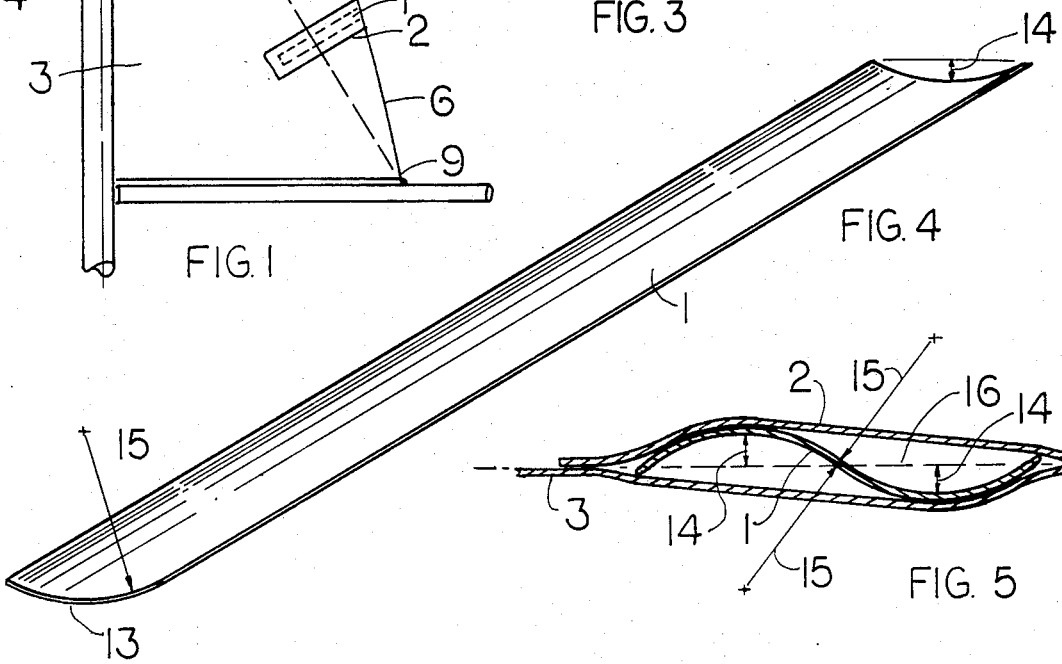
FIG. 4
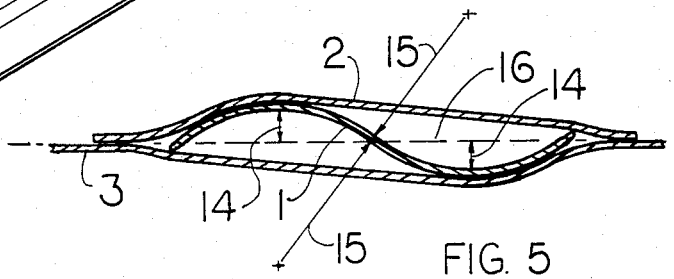
FIG. 5
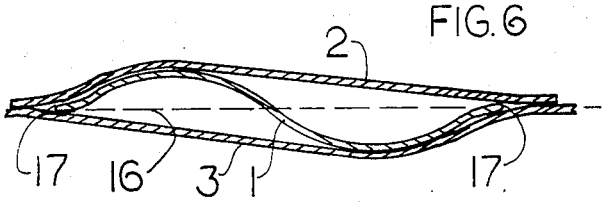
FIG. 6
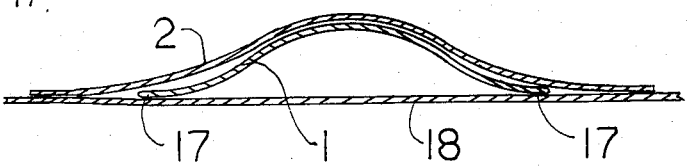
FIG. 7
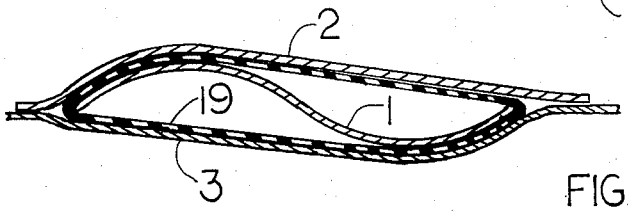
FIG. 8

FIG. 9
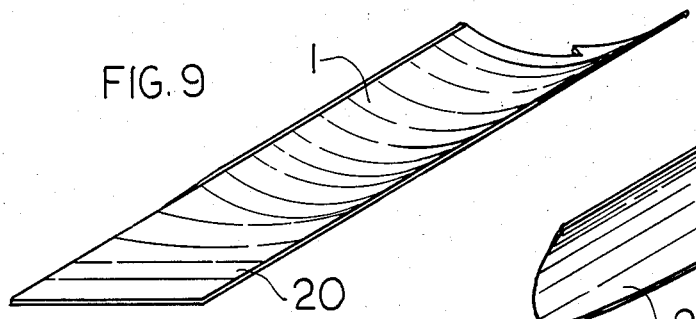
FIG. 10
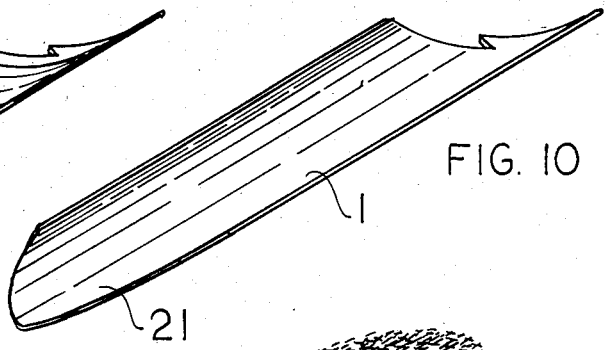
FIG. 11
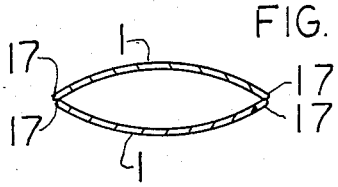
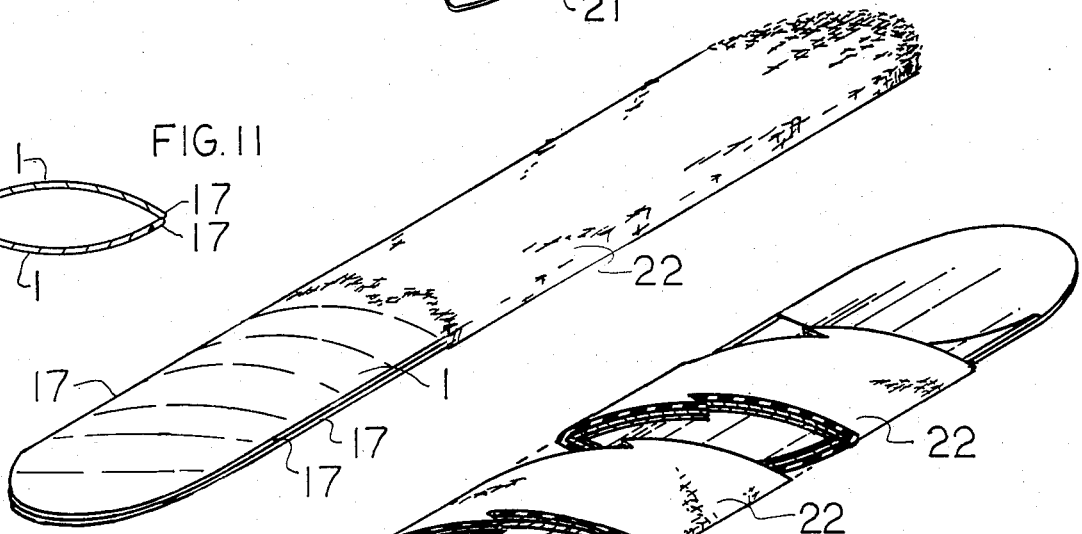
FIG. 12
FIG. 13
FIG. 14
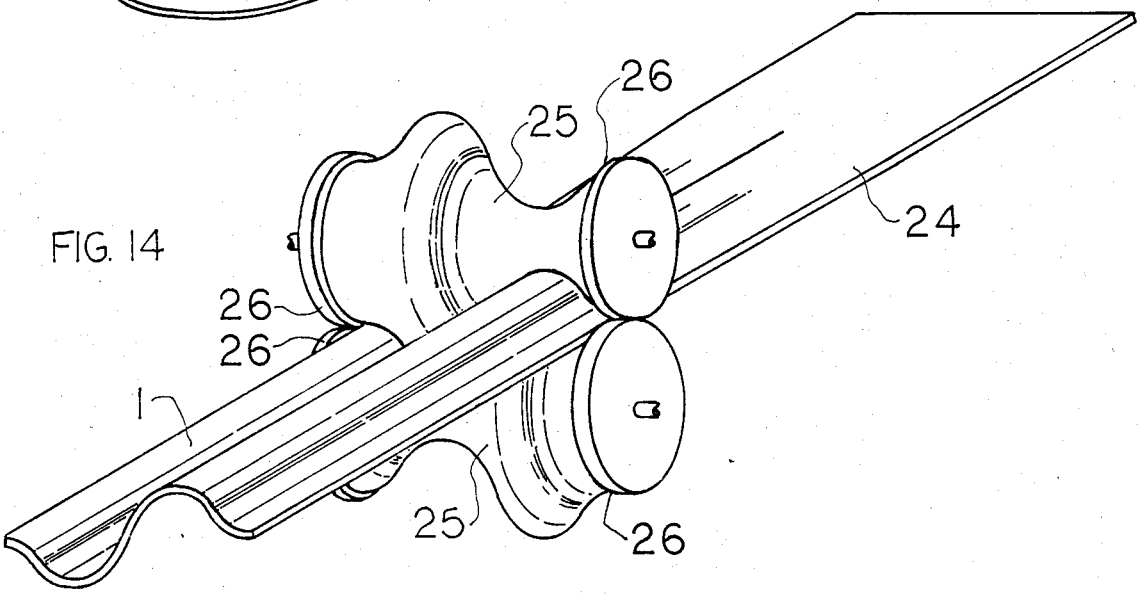

SAILBOAT BATTENS

This application is a continuation of application Ser. No. 214,457, filed 12/08/80, now abandoned.

BACKGROUND OF THE INVENTION

It has frequently been the practice to install battens (stiffeners) in sails to enlarge the sail area which could be carried effectively on a given rig. However, improvements in the art of battens have not kept pace with recent improvements in sailing rigs. Recent improvements in so-called roller-furling sail rigs have made such rigs quite popular. These rigs are popular at least in part because of the speed and ease with which sail area can be adjusted. In these rigs the sail is generally wound up around a axis which runs along the leading edge (luff) of the sail. However, one of the drawbacks of these rigs has been that no batten is available which will both stiffen the free or trailing edge (leech) of the sail when the sail is set and also roll up with the sail when the sail is furled.

SUMMARY OF THE INVENTION

The present invention comprises a batten especially for a roller-furling sail. The batten is made from a thin resilient material formed into a long batten with a curved cross-section so as to stiffen the sail when the sail is set. When the sail is furled around a stay or other axis the curved cross-section flattens due to the resilience of the material, and the batten easily wraps up around the stay with the sail.

Various secondary objects and advantages of the invention relate to the needs to minimize wear (chafe) on the sail and to optimize the aerodynamic shape, to reduce cost and to assure durability.

Several solutions to this combination of problems are provided. Chafe is minimized by providing flattened and/or tapered ends for the batten. Symmetry of bending is provided by the combination of simple curved resilient elements either in series or in parallel. A method of manufacture is provided. Curvatures which minimize chafe and batten fatigue are provided. A suitable batten pocket is provided.

DESCRIPTION OF THE SEVERAL VIEWS

FIG. 1 is a side view of the invention installed in a roller-furling mainsail.

FIG. 2 is a side view showing the method of assemblage of the invention.

FIG. 3 is a side view showing another method of assemblage.

FIG. 4 is an oblique view of a basic element of the invention.

FIGS. 5 through 8 are cross-section views of the batten element in accordance with the invention.

FIGS. 9 through 10 are oblique views of the ends of batten elements, also within the scope of the invention.

FIG. 11 is a cross-section view of a combination of batten elements in accordance with the invention.

FIG. 12 is an oblique view of a particular embodiment of the invention.

FIG. 13 is a partially sectional abbreviated oblique view of a particular embodiment of the invention.

FIG. 14 is an oblique view of a method of forming a batten element in accordance with the invention.

DETAILED DESCRIPTION

FIG. 1 is a view of the present invention 1 in pockets 2 installed on a roller furling main sail 3 of a fore and aft rig. The sail shown in the figure, is partially furled or reefed around a stay 8 inside mast 4. This is only one embodiment of the present invention. Others will be obvious to those skilled in the art. For example, a sail battened in accordance with the present invention may also be furled about a mast itself, or a strut within a mast. Dotted line 5 indicates location of leech edge 6 to which the prior art roller furling sail is restricted in the absence of battens such as the present invention. It is clear from the angle 7 which the battens normally make with the mast 4 that the battens will form a helical coil about the axis 8 of furling. Consequently the bulk of the batten will not tend to build up excessively and jam inside the mast 4, especially if proper tension is maintained on clew 9 when furling.

The batten pocket 2 may be provided with an overlapping opening and/or an elastic end according to the prior art.

FIG. 2: More suitable for the accommodation of the present invention is a batten pocket whose opening is located between the ends. As shown in the figure, the batten 1 may be folded in half and both ends slipped simultaneously through a slot 10 between the pocket 2 and the equally long sail 3, the slot being located between the two ends of the pocket. After the batten has been slipped into the pocket it is easily rotated 90° around its longitudinal axis so as to lie properly in the plane of the sail. Such a pocket may be fitted with an elastic end 11 so as to allow for longitudinal slippage between the batten and the sail during roller furling.

FIG. 3: Alternatively, the forward end of the batten may be sewed 12 to the pocket and the pocket may be left open at the leech 6 so as to avoid leech chafe.

FIG. 4: In its simplest form, the batten 1 is comprised of a single element of resilient material with a cross-section forming a simple arc 13. The depth 14 of curvature of the arc 10 is small relative to the radius 15 of curvature, so as to minimize aerodynamic drag.

FIG. 5: For symmetry in bending about the plane 16 of the sail the cross-section forms a curve with an even number of equally long radii 15 of curvature. As shown in the figure, the individual arcs corresponding to the individual radii may be aligned with colinear end points so as to form a smooth curve, therby minimizing batten fatique due to flexure.

Of course a sinusoidal or other smooth semi-symmetrical curve is included within the scope of the invention.

FIG. 6: To reduce chafe on the batten pocket 2, the edges 17 of the batten may be faired into the plane 16 of the sail.

FIG. 7: Another variation is inspired by asymmetry of tension across the batten pocket. One side of the batten pocket is the sail itself. The other side is added sailcloth. In general the tension on the sail side will be higher. Chafe is minimized by mounting the pocket on the outside 18 of the sail with respect to its rotation about the axis 8 of furling and by designing the batten with an asymmetrical cross-section as shown. This combination minimizes chafe due to the batten edges 17 because they will tend to lift off the sail when furling.

FIG. 8: Still another way of reducing chafe is to provide a replaceable sheath 19 between the batten and the pocket.

FIG. 9 and FIG. 10: To reduce chafe on the ends of the batten pocket, the batten 1 may be provided with flattened ends 20 or tapered ends 21.

FIG. 11: Symmetry in bending may also be provided by the combination of two single batten elements 1 of curved cross-section superimposed longitudinally in such a way that their edges 17 are approximately colinear.

FIG. 12: The superimposed edges 17 of the elements 1 may be held together by a tight batten pocket or by a tight elastic sheath 22. This increases the rigidity of the batten when the sail is set but it does not greatly increase its resistance to roller furling because the batten elements 1 are free to slip longitudinally relative to each other.

FIG. 13: Additional pairs of resilient elements 1 of curved cross-section may be combined so as to increase the stiffness of the batten. Positioning a shorter pair between the ends of a longer pair provides added stiffness without increasing the danger of chafe caused by stiff ends. If necessary, bonding 23 of elements is provided, but only at the forward end in order to allow for longitudinal slippage of the elements during roller furling.

FIG. 14: The present invention may be fabricated by conventional means. For example, the batten elements 1 may be formed by passing flat stock 24 between rollers 25 of appropriate shape. Guides 26 may be provided directly on the rollers 25 to insure proper alignment of the batten stock on the rollers. Additional rollers (not shown) may also be used as guides, of course.

We claim:

1. A sail batten comprised of at least one long thin resilient element of curved cross-section so that when a plurality of said battens is installed in the leech of a sail at an angle to the mast, said battens are not only stiff enough to keep the leech of the sail from curling when the sail is set, but also flexible enough to be wrapped into a helical coil with the sail around an axis which runs parallel to the mast.

2. The batten of claim 1 in combination with a pocket securing said batten to a sail, said pocket having an elastic part located so as to contain that end of said batten which is wrapped last so as to allow for relative movement of said batten and said sail during the wrapping process.

3. The batten of claim 1 in combination with a pocket securing said batten to a sail, said pocket being open at the end which is wrapped last, and furthermore said batten being fastened into said pocket at the end of said pocket which is closest to the wrapping axis.

4. The batten of claim 1 in combination with a pocket securing said batten to a sail, said pocket having an opening for insertion of said batten, and said opening being located between the two ends of said pocket.

5. The batten of claim 1 wherein the line of said curved cross-section forms a continuously smooth curve with sections of opposed curvature so that the batten is equally stiff on either tack and free of large stress gradients when flattened during the wrapping process.

6. The batten of claim 5 in which the edges of said batten are faired into the plane of the sail so as to reduce chafe.

7. The batten of claim 1 in which the line of said curved cross-section has a shape comprised of two or more arcs of a circle, said arcs are connected in series, said arcs have colinear end points, and said arcs have alternately opposed directions of curvature so as to be equally stiff on either tack.

8. The batten of claim 7 in which the edges of said batten are faired into the plane of the sail so as to reduce chafe.

9. The batten of claim 1 in which said batten furthermore is comprised of at least one pair of said elements, the longitudinal edges of said elements being superimposed, and said elements having mutrually opposed curvature so as to render said batten equally stiff on either tack.

10. The batten of claim 9 in which said batten is enclosed within a tight and elastic sheath so as to hold together said longitudinal superimposed edges of said elements, thereby increasing the rigidity of said batten without significantly increasing its resistance to wrapping.

11. The batten of claim 1 in which two or more of said elements are joined near a longitudinal end of one of said elements, said end being the first end of said element to be wrapped with said sail.

* * * * *